United States Patent [19]

Shirk

[11] 4,453,309

[45] Jun. 12, 1984

[54] MANUFACTURE OF DENSE, FLAT CONDUCTOR CONNECTORS

[75] Inventor: Albert Shirk, Palmyra, Pa.

[73] Assignee: AMP Incorporated

[21] Appl. No.: 323,218

[22] Filed: Nov. 20, 1981

[51] Int. Cl.[3] ..... H01R 43/00

[52] U.S. Cl. ..... 29/884; 242/117

[58] Field of Search ..... 29/846, 850, 884, 882; 242/117

[56] References Cited

U.S. PATENT DOCUMENTS

| | | | |
|---|---|---|---|
| 3,465,308 | 9/1969 | Sasaki et al. | 29/850 X |
| 3,755,892 | 9/1973 | Dieterich | 29/884 X |
| 3,818,414 | 6/1974 | Davies | 339/17 M |
| 3,934,959 | 1/1976 | Gilissen . | |
| 3,985,413 | 10/1976 | Evans . | |
| 4,028,794 | 6/1977 | Ritchie et al. . | |
| 4,034,932 | 7/1977 | Ferch | 242/117 |

*Primary Examiner*—Howard N. Goldberg
*Assistant Examiner*—Carl J. Arbes
*Attorney, Agent, or Firm*—Donald M. Boles; Gerald K. Kita

[57] ABSTRACT

The present invention relates to manufacture of electrical conductors by winding small gauge wires helically on a drum, bonding the wires to a flexible sheet of polymeric material also wrapped on the drum, and stripping from the drum the composite of wires and polymeric material that form an array of flat, spring resilient, lengths of substantially parallel conductors.

6 Claims, 7 Drawing Figures

MANUFACTURE OF DENSE, FLAT CONDUCTOR CONNECTORS

There is known in U.S. Pat. No. 4,028,794 a flat electrical connector in which resilient flat conductors are bonded to a backing of flexible, insulative polymeric material. The conductors are spaced apart, metal strips which are individually bonded by adhesive to the backing. The invention resides in small gauge lengths of closely spaced wires held in a planar array by a flexible, insulative backing. The high density of parallel wires maximizes the number of separate conductor paths and promotes mechanical forming and good spring characteristics.

High density conductors are disclosed in U.S. Pat. No. 3,985,413. The conductors are plated onto a flexible backing and requires a resilient polymeric mass to provide resilient spring characteristics. Another high density connector is disclosed in U.S. Pat. No. 3,934,959. Multiple loops of conductors are imbedded in a polymeric mass. These conductors are difficult to form in different shapes, subsequent to being imbedded in the polymeric mass.

The present invention is characterised in that a method for fabricating a sheet of electrically isolated metal conductors comprises, winding a conductive round wire in helical, closely spaced coils over a cylindrical drum, wrapping a sheet of flexible polymeric material over the coils, bonding the coils to the sheet with a layer of adhesive material, severing the composite of sheet and coils, and stripping the composite from the drum, resulting in a sheet of densely grouped, electrically isolated, parallel conductors.

Further the invention is characterised by the composite including round wires of resilient spring properties, and the composite is adapted for stamping and forming into one or more electrical connectors.

An object of the invention is to provide a method for fabricating electrically isolated and densely spaced conductors in a planar array.

Another object is to provide a planar array of round wire conductors partially imbedded in a layer of adhesive and in registration against a backing sheet of flexible polymeric.

Other objects and advantages will become apparent by way of example from the following description and accompanying drawings.

FIG. 1 of the drawings is a schematic perspective view of a drum and a spool supplying round wire.

Figure 1:
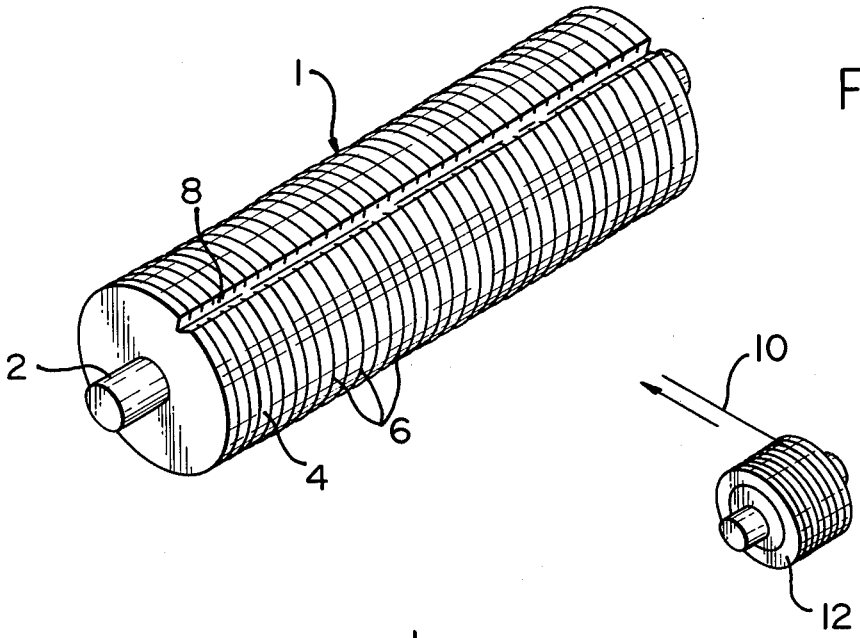
Figure 2:
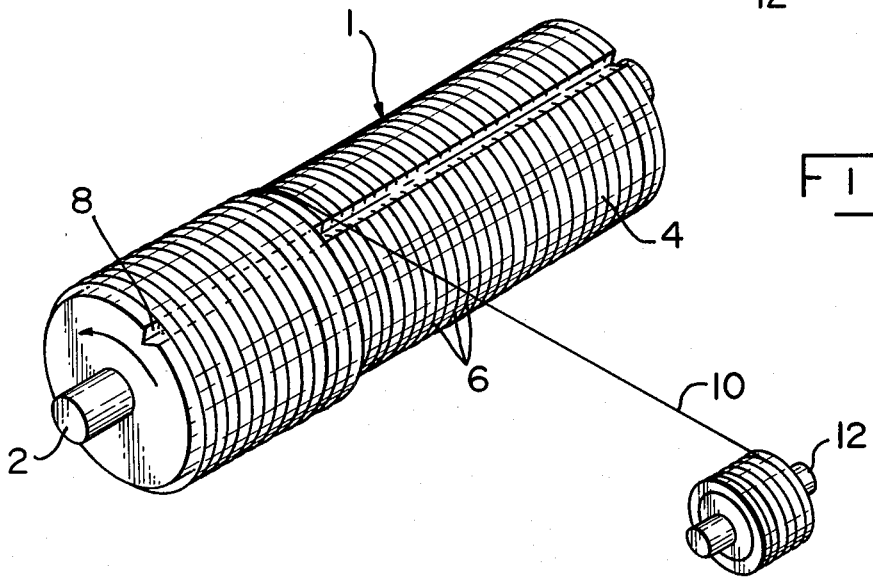
FIG. 2 is a schematic perspective view of round wire supplied by the spool and helically wound in coils upon the cylindrical surface of the drum.

FIG. 1 shows a cylindrical drum 1 rotatable on an axle 2. The cylindrical surface 4 of the drum 1 is provided with a slender and continuous helical groove 6 and a straight channel 8 intersecting each revolution of the groove 6. The channel 8 has a depth greater than that of the groove 6. FIG. 2 shows a round wire 10 supplied by a spool 12 and wound helically in spaced coils on the drum 1 within the groove 6. The width and depth of the groove 6 is less than the diameter of the wire 10, so that the coils project from the surface 4 of the drum 1 while being held in the groove 6. In practice the pitch of the groove 6 is only slightly larger than the diameter of the wire 10, so that the coils are electrically isolated but densely grouped together. The drum is rotated to wind the wire thereon. Tension, of an amount less than the yield strength of the wire, is applied during winding to insure tightly wrapped coils.

Figure 3:
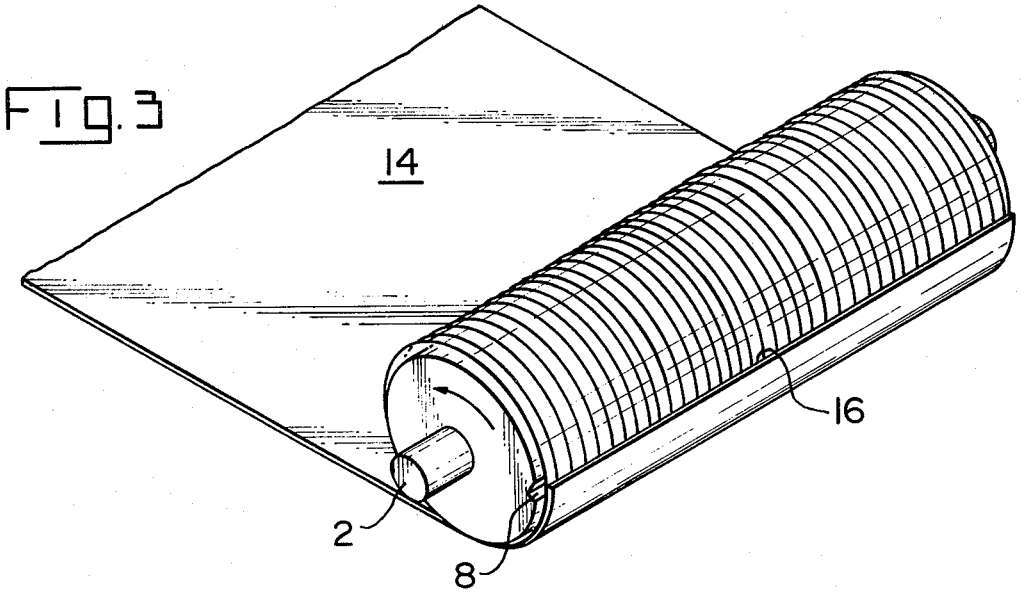
FIG. 3 is a schematic perspective view of a polymeric flexible sheet being wrapped over the coils.

FIG. 3 illustrates a sheet 14 of flexible polymeric material wrapped over the coils. An edge 16 of the sheet overlies the channel 8.

Figure 6:
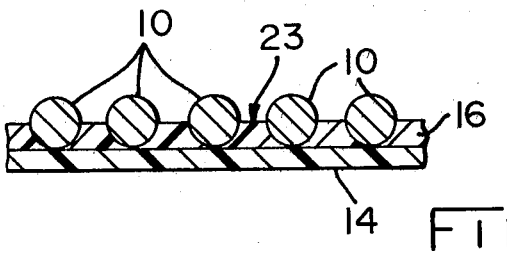
FIG. 6 is a fragmentary view in section taken along the line 6—6 of FIG. 5.

FIG. 6 shows the sheet 14 carrying an adhered layer 16, of adhesive material available in commerce, of a uniform thickness less than the diameter of the wire 10 and of a minimum thickness sufficient to become displaced by the coils of wire 10 being partially imbedded in the layer 16 and in registration against the sheet 14. The conductors may be imbedded more than one-half the diameters thereof, so that the conductors are mechanically locked in the adhesive. Pressure is applied to the sheet 14 to imbed the coils. The adhesive is cured, under the pressure, temperature and other environmental conditions, recommended by the supplier of the adhesive.

Figure 4:
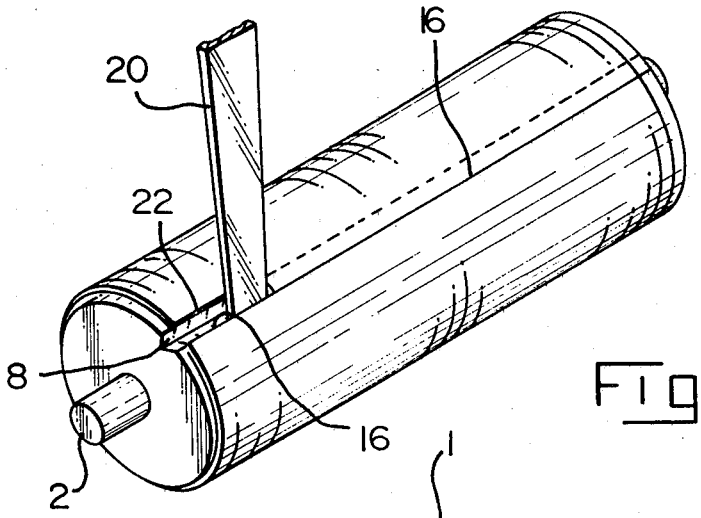
FIG. 4 is a schematic perspective view of a composite of the sheet and coils being severed.
Figure 5:
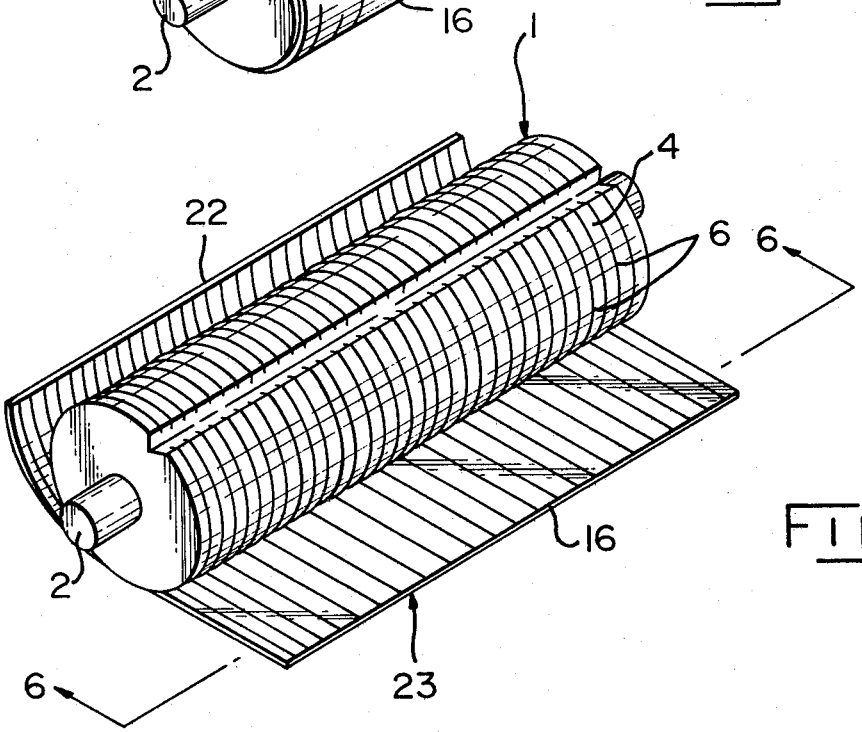
FIG. 5 is a view similar to FIG. 4 showing stripping the composite from the drum.
Figure 7:
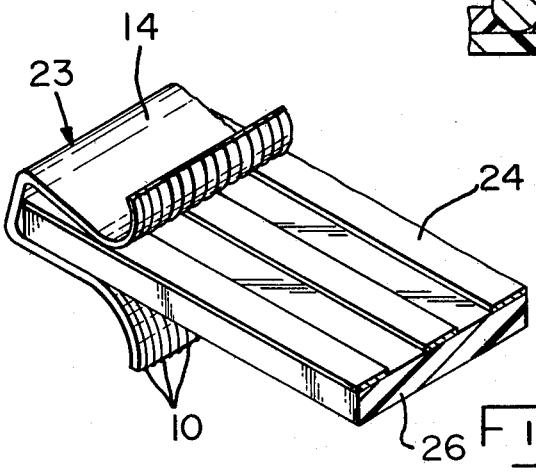
FIG. 7 is a fragmentary perspective view of a resilient electrical connector mounted in a circuit board.

FIG. 4 shows the sheet 14 fully applied and assembled over the wire coils. A knife 20 severs the sheet 14 and the coils leaving edge margins 16 and 22 of the sheet, and parallel lengths of spaced, densely grouped, wires 10 extending from one margin 16 to the other margin 22. The channel 8 is used as a guide to direct the knife 20. FIGS. 5 and 6 shows the composite 23 of sheet 14, adhesive 16 and wires 10 being stripped from the drum 1, and flattened, ready for stamping and forming into a connector of desired configuration. For example, the composite 23 is folded in concertina form as shown in FIG. 7, providing a connector with the wires 10 providing a multiplicity of contacts engaging respective conductors 24 of a circuit board 26. Due to dense side-by-side spacing of the wires 10, multiple wires 10 may engage a single conductor 24 and provide redundant, independent electrical connections. The wires 10 may be selected of a material with resilient spring properties. Thereby, when the concertina form is deflected resiliently, resilient spring energy is stored and utilized to apply pressure at the points of contact between the wires 10 and the conductors 24. Thereby, electrical and mechanical contact are enhanced. Further, the circuit board 26 may be inserted between concertina folds, deflecting the folds resiliently apart. The stored spring energy of the deflected folds applies gripping pressure, holding the concertina form assembled on the circuit board 26. Other modifications and embodiments of the invention are intended to be covered by the spirit and scope of the claims. For example, concertina or three-dimensional forms that differ from that shown in FIG. 7 are readily made according to the claims.

EXAMPLE 1

Beryllium copper wire 0.005 inches in diameter with 50 microinches of nickel plating was wound in a groove of a stainless steel drum, 12 inches in diameter, and machined with a helical groove 0.002 inches deep and having a pitch of 0.0069 inches. The wire is available in commerce, for example, from R&F Alloy Wire, Inc., Fairfield, N.J., U.S.A. 07006. A sheet of 0.002 inches thick polyethylene teraphalate coated with a layer of adhesive, namely No. 416 Adhesive available from Air Reduction Company, Allentown, Pa., U.S.A., was wrapped over the windings of wire. The wires were bonded to and partially imbedded in the adhesive. The adhesive was cured at 390° Fahrenheit, according to instructions provided by the supplier, permanently bonding the wires and polymeric sheet into a composite cable. The cable was severed transversely of the conductors and stripped from the drum. The cable then was stamped and formed into a multiplicity of C-shaped, resilient connectors each 0.050 inches in height.

What is claimed is:

1. A method for fabricating a sheet of isolated metal conductors, comprising the steps of:

winding a conductive round wire in a helix having spaced apart coils over a grooved cylindrical drum, wrapping over the coils a sheet of flexible polymeric material having a layer of adhesive between and adhering to the coils and the sheet, applying pressure to the sheet, severing the sheet and the coils, stripping from the drum a composite of the sheet and the severed coils, and flattening the coils and the sheet to provide an array of parallel, closely spaced conductors.

2. The method as recited in claim 1, wherein the groove is a helical groove of a depth less than the diameter of the wire, and further including the steps of, holding the wire in the helical groove while partially imbedding the wire in the adhesive.

3. The method as recited in claim 1, wherein the wire is selected with metal spring properties, and further including the step of, stamping and forming the composite into one or more three-dimensional electrical connectors.

4. The method as recited in claims 1 or 2 or 3, and further including the steps of, displacing the layer of adhesive with the imbedded coils, and engaging the imbedded coils against the sheet.

5. The methods as recited in claims 1 or 2 or 3 in which more than one-half the peripheries of the round conductors are embedded in the adhesive.

6. At method for fabricating a sheet of isolated metal conductors, comprising the steps of:

winding a conductive ground wire in a helix having spaced apart coils over a helically grooved cylindrical drum wherein the helical groove has a depth less than the diameter of the wire, wrapping over the coils a sheet of flexible polymeric material having a layer of adhesive between and adhering to the coils and the sheet wherein the wire is held in the helical groove while being partially embedded in the adhesive, applying pressure to the sheet, severing the sheet and the coils, stripping from the drum a composite of the sheet and the severed coils and flattening the coils and the sheet to provide an array of parallel, closely spaced conductors.

* * * * *